US007089873B2

(12) United States Patent
Yoshida

(10) Patent No.: US 7,089,873 B2
(45) Date of Patent: Aug. 15, 2006

(54) EMBROIDERY FRAME CARRIER FOR EMBROIDERY SEWING MACHINE

(75) Inventor: Masaki Yoshida, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/167,161

(22) Filed: Jun. 28, 2005

(65) Prior Publication Data

US 2006/0011122 A1 Jan. 19, 2006

(30) Foreign Application Priority Data

Jun. 30, 2004 (JP) ..... 2004-193594

(51) Int. Cl.
*D05C 9/04* (2006.01)

(52) U.S. Cl. ..... 112/103; 112/470.14

(58) Field of Classification Search ..... 112/470.06, 112/470.09, 470.14, 470.18, 103, 119, 475.18, 112/102.5
See application file for complete search history.

(56) References Cited

U.S. PATENT DOCUMENTS 5,291,843 A * 3/1994 Hori ..... 112/103
5,630,370 A * 5/1997 Herbach ..... 112/103
6,138,592 A * 10/2000 Seneff ..... 112/103
6,553,926 B1 * 4/2003 Stucki ..... 112/102.5

FOREIGN PATENT DOCUMENTS

JP A 2002-52284 2/2002

* cited by examiner

*Primary Examiner*—Ismael Izaguirre

(74) *Attorney, Agent, or Firm*—Oliff & Berridge, PLC

(57) ABSTRACT

An embroidery frame carrier for an embroidery sewing machine moves an embroidery frame holding work cloth to be embroidered in two mutually perpendicular directions. The embroidery frame carrier includes a carriage, a carrier mechanism freely moving the carriage in the two directions, an engagement mechanism including an engagement groove formed on either one of the carriage or the connector of the embroidery frame and an engagement mounted on the other so as to engage the engagement groove, the engagement mechanism engaging the connector to the carriage so that the connector is slidable on the carriage, a lock portion of the carriage to lock the connector of the embroidery frame to a predetermined location, a lock mechanism to lock the connector engaged by the engagement mechanism, and a lock member of the lock mechanism to be switched between a pressed position and a released position.

15 Claims, 9 Drawing Sheets

EMBROIDERY FRAME CARRIER FOR EMBROIDERY SEWING MACHINE

BACKGROUND OF THE INVENTION

1. Field of the Invention

The present invention relates to an embroidery sewing machine and more particularly to an embroidery sewing machine having an embroidery frame carrier to freely move the embroidery frame holding the embroidery fabric in two mutually perpendicular directions.

2. Description of the Related Art

Conventionally, an embroidery frame carrier of a general embroidery sewing machine is provided with an embroidery frame, a carriage to which the embroidery frame is detachably attached, a Y direction carrier mechanism to move the carriage to the direction of the width of a sewing machine bed (Y direction) and an X direction carrier mechanism to move the carriage towards direction of the length of the sewing machine bed (X direction) and the like. This embroidery frame carrier carries the embroidery frame holding work cloth to the X direction and the Y direction so that an embroidery pattern is formed on the work cloth by a sewing mechanism of the sewing machine.

In a conventional embroidery frame carrier, various structures to attach/detach the embroidery frame to the carriage have been reduced to practice. For example JP-A-2002-52284 discloses an embroidery frame carrier enabling the attachment/detachment of plurality types of embroidery frames having variously sized and shaped fabric holders to hold the work cloth.

This embroidery frame carrier is configured by an engagement mechanism to engage a connector of the embroidery frame by sliding the connector in the front-rear direction (widthwise with respect to the bed), a lock mechanism to fix the connector of the embroidery frame, which is engaged to a frame attachment position by the engagement mechanism to the carriage and a location mechanism to locate the embroidery frame to the frame attachment position.

The aforesaid engagement mechanism is configured by an engagement groove extending in the front-rear direction on an upper surface of a protrusion of the carriage and an engaging convexity elongated in the front-rear direction is formed on the lower end of the connector of the embroidery frame. The embroidery frame is attached to the attachment position by slidingly engaging the engagement convexity to the engagement groove.

The lock mechanism includes a lock member and biasing member provided on the carriage. The lock member is provided moveably from the pressure position to press the connector against the carriage and the release position to release the connector from a pressed state.

The locating mechanism is configured by a protrusion provided on the lock member and a concaving groove provided on an embroidery frame to fit with the protrusion. The embroidery frame is located in a predetermined frame attachment position by fitting the protrusion to the concave groove.

In a structure for mounting the embroidery frame to the carriage, it is important for the embroidery frame to be fixed without play in the mounted state as well as providing smooth attachment/detachment of the embroidery frame for the user. In the above described construction, the embroidery frame is fixed without vertical play by pressing the connector against the carriage by the lock mechanism.

However, since the concave groove of the location mechanism is integrally provided with the embroidery frame, there is a concern of dimensional errors of the concave grooves of the embroidery frames resulting from errors in the manufacture of embroidery frames. Therefore, in some embroidery frames, a play results from the fitting of the concave groove and the protrusion of the lock member. Because of such play, the embroidery frame is rattled in the front-rear direction (sliding direction) during the embroidery frame transfer, leading to misalignment of seams.

Since each of the concave groove and protrusion are small in shape, it is difficult for the user to see whether the protrusion is securely fitted into the concave groove. This gives rise to concerns of starting the sewing process with the connector of the embroidery frame insecurely fixed (the so called premature insertion) to the carriage which also leads to misalignment of the seams at the time of embroidery sew.

Also, in order to reliably maintain the horizontal disposition of the embroidery frame attached to the carriage, the bias on the biasing member to pressure the lock member needs to be increased. However, if the bias is increased, a burdensome operation to operate the lock mechanism will be required to resist the bias, leading to the impairment of the ease of the attachment/detachment of the embroidery frame.

SUMMARY OF THE INVENTION

Therefore, an object of the present invention is to provide an embroidery frame carrier for an embroidery sewing machine capable of effectively preventing the play of the connector, when the embroidery frame is attached to the carriage to prevent the misalignment of the seams.

It is an object of the invention to provide a first embroidery frame carrier for an embroidery sewing machine, which carrier moves an embroidery frame holding work cloth to be embroidered in two mutually perpendicular directions. The embroidery frame carrier comprises a carriage to which a connector on an end portion of the embroidery frame is detachably mounted to support the embroidery frame, a carrier mechanism freely moving the carriage in the two mutually perpendicular directions, an engagement mechanism including an engagement groove provided on either one of the carriage or the connector of the embroidery frame and an engagement provided on the other so as to engage the engagement groove, the engagement mechanism engaging the connector to the carriage so that the connector is slidable on the carriage, a lock portion provided in the carriage to lock the connector of the embroidery frame to a predetermined location in a sliding direction, a lock mechanism provided in the carriage to lock the connector engaged by the engagement mechanism in a fixed state, and a lock member provided in the lock mechanism to be switched between a pressed position in which the connector is pressed against the fastener and a released position in which the connector is released from a pressed state.

The embroidery frame carrier of the embroidery sewing machine having the above configuration is enabled to create embroidery by freely moving the carriage in the two mutually perpendicular directions by the carrier mechanism with the embroidery frame holding the embroidery fabric attached to the carriage. When attaching the embroidery frame to the carriage, first, the user is to slide the connector of the embroidery frame so that the engagement is engaged to the engagement groove. This slide movement is to be carried out with the lock member of the lock mechanism disposed in the release position.

As the connector is slid into the carriage and reaches the predetermined position, the connector becomes fastened to the fastener. At that point, when the lock member of the lock mechanism is switched to the pressured position, the connector engaged by the engagement mechanism is pressed against the fastener to be fixedly locked by the lock mechanism. When removing the embroidery frame from the carriage, the opposite of the above is to be carried out wherein the lock member is switched to the release position and the connector is disengaged from the engagement mechanism by sliding it to the opposite direction. Thus, a smooth attachment/detachment of the embroidery frame can be carried out by the user.

At this point, by locking the connector fastened by the fastener by pressing it against the fastener, the play in the sliding direction of the connector attached with the embroidery frame can be prevented. Also, the user can easily see whether the lock member is in the pressured position or the release position and start sewing with the connector of the embroidery frame securely fixed to the carriage.

In the present invention, on either one of the fastener or the contacting portion, which is provided on the end of the connector of the embroidery frame in the sliding direction and contacted by the fastener, an elastic member can be provided to render an elastic contact of the fastener and the contacting portion. The elastic contact of the connector to the fastener prevents the play in the sliding direction which creates a substantial advantage. This elastic member can be configured by the fastening plate spring.

The lock member can be configured by a rotating lever having one end rotatably supported by the carriage. The switch between the pressured position and the release position can be made with the user's simple operation of rotating the rotating lever and a good visibility of the lever position is also obtained.

The rotating lever may be provided in the position to sandwich the connector of the embroidery frame, which is engaged to the carriage, with the fastener; as well as being configured to lie in parallel to the sliding direction of the connector of the embroidery frame in the pressured position and stand upright against the sliding direction in released position. Thus the disposition of the lever, that is, the indication whether the connector is locked in the fixed state or not can be visibly confirmed even more clearly. Also, in the pressured position, because the rotating lever is disposed in nearly parallel to the sliding direction of the connector of the embroidery frame, it does not interfere with the operation of the embroidery sewing machine.

Furthermore, on the rotating lever, a contacting portion to contact the connector of the embroidery frame level to or slightly above the rotational center of the rotating lever in the pressured position can be provided. Even if the rotating lever is affected by the reaction force generated when the connector of the embroidery frame is pressed, the reaction force does not operate in the direction to erect the rotating lever. Therefore, the loosening of the lock caused by inadvertent rotation of the rotating lever can be prevented.

In the present invention, a biasing member to bias the connector elastically can be provided in the direction to pressure the engagement to the engagement groove. This will further effectively prevent the play of the connector in the engaging direction of the engagement groove and the engagement.

The configuration of the biasing member with a holding plate spring offers a simple configuration. In this case, it is preferable to set the pressure power of the holding plate spring such that does not prevent the sliding movement of the connector. This will in turn restrain the force required to slide the connector to a relatively small amount to simplify the attachment/detachment of the embroidery frame by the user and also prevents the functioning of the fastening plate spring from being impaired by the holding plate spring.

It is another object of the present invention to provide a second embroidery frame carrier for an embroidery sewing machine, which carrier moves an embroidery frame in two mutually perpendicular directions, the embroidery frame having a frame-shaped cloth holder holding work cloth to be embroidered and a connector provided on an end of the cloth holder. The embroidery frame carrier comprises a carriage to which the connector of the embroidery frame is detachably mounted to support the embroidery frame, a carrier mechanism freely moving the carriage in the two mutually perpendicular directions, an engagement mechanism including an engagement groove provided on either one of the carriage or the connector of the embroidery frame and an engagement provided on the other so as to engage the engagement groove, the engagement mechanism engaging the connector to the carriage so that the connector is slidable on the carriage, a biasing member provided on the engagement mechanism to elastically bias the connector in such a direction that the engagement of the engagement mechanism is pressed against the engagement groove while the engagement is in engagement with the engagement groove and a carriage abutment portion provided in an area of the connector closer to the cloth holder so as to abut against the carriage on a surface of the carriage abutment portion opposing to a portion of the connector pressed by the biasing member.

The embroidery frame carrier of the embroidery sewing machine having the above configuration is enabled to create embroidery by freely moving the carriage in the 2 mutually perpendicular directions by the carrier mechanism with the embroidery frame holding the embroidery fabric attached to the carriage. When attaching the embroidery frame to the carriage, first, the user is to slide the connector of the embroidery frame so that the engagement is engaged to the engagement groove. When removing the embroidery frame from the carriage, the opposite of the above is to be carried out wherein the connector is disengaged from the engagement mechanism by sliding it to the opposite direction.

When the engagement is engaged to the engagement groove, the play of the connector in the engaging direction of the engagement groove can be prevented because the connector is biased in the direction to pressure the engagement against the engagement groove. Since the carriage contacting portion provided on the connector contacts the carriage in the surface opposite of the side pressured by the elastic member, the location of the connector against the engagement direction is carried out and the engagement and the attachment of the embroidery frame is maintained.

The carriage contacting portion can be configured by a plurality of ribs formed on the bottom surface of the connector while the plurality of ribs are formed in the height that retains the horizontal disposition of the fabric holder. The horizontal disposition of the fabric holder with the embroidery frame attached can be retained.

The configuration of the biasing member with a holding plate spring offers a simple configuration. In this case, the holding plate spring can be configured to have a fixture fixed to the carriage and a free end pressuring and contacting the connector. The holding plate spring can be formed to extend nearly parallel to the engagement groove, while the pressure power of the free end is arranged to operate to both the connector and engagement groove in two directions respectively, one of which is the direction to pressure the engagement and the other which is the direction nearly in parallel to the sliding direction. This arrangement restrains the force required to slide the connector to a relatively small amount to simplify the attachment/detachment of the embroidery frame by the user.

Furthermore, the free end of the holding plate spring can be arranged in the front side of the sliding direction to which the connector is oriented on engaging the connector to the carriage. Alternatively, an insertion can be provided in the carriage to insert the end of the connector when engaging the connector to the carriage and the free end of the holding plate spring can be arranged in the vicinity of the insertion. In either case in the early stages of engaging the connector to the carriage, the force required to slide the connector can be restrained to a relatively small amount.

BRIEF DESCRIPTION OF THE DRAWINGS

Other objects, features and advantages of the present invention will become clear upon reviewing the following description of the embodiment with reference to the accompanying drawings, in which.

PIG. 9 shows a vertical rear elevation view of the connector along line 9—9 in FIG. 3.

DETAILED DESCRIPTION OF THE INVENTION

Figure 1:
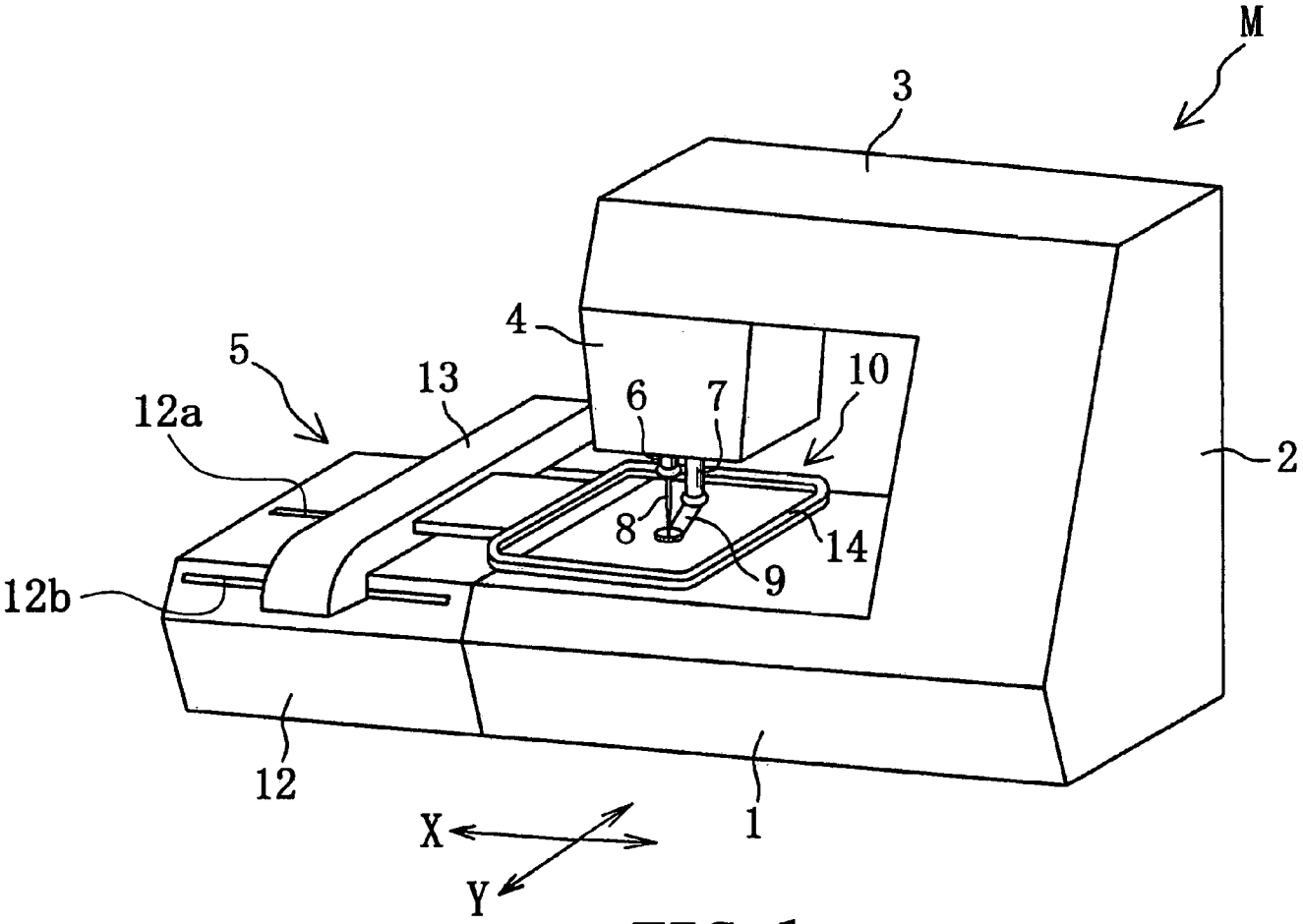
FIG. 1 shows a perspective view of the embroidery sewing machine in accordance with an embodiment of the present invention.
Figure 2:
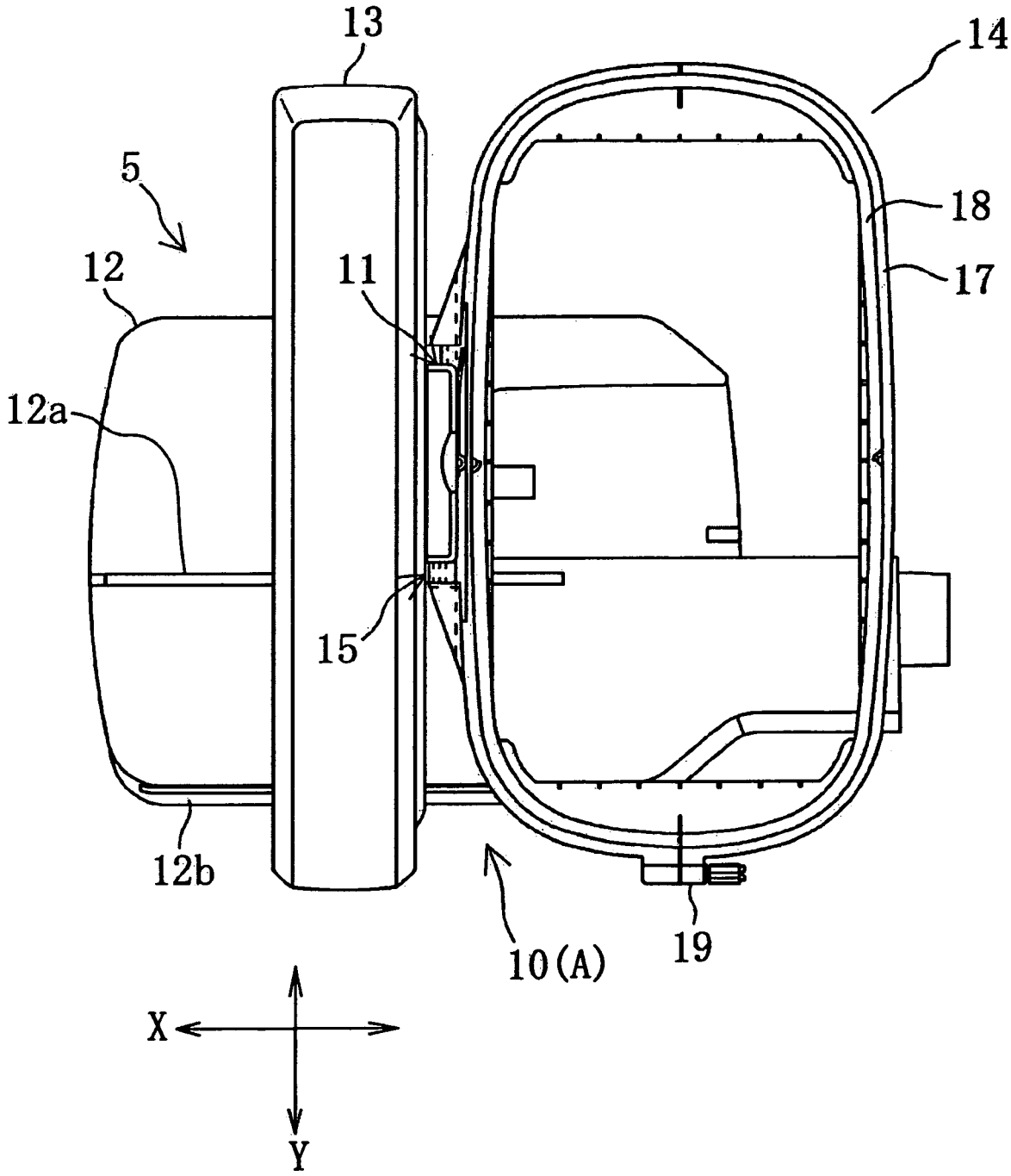
FIG. 2 shows a plan view of an embroidery frame carrier.

An embodiment according to the present invention applied to a household embroidery sewing machine is described with reference to the drawings herein under. First, FIG. 1 shows the exterior of the sewing machine M related to the current invention. The sewing machine M as known in the art is configured by a bed 1, a pillar 2, an arm 3 and a head 4. On the left end of the bed 1, an embroidery frame carrier 5 involved in the present invention is attached detachably. This embroidery frame carrier 5 is for freely moving the embroidery frame 10 holding the embroidery fabric (not shown) on the bed 1 in the two mutually perpendicular directions(X direction and Y direction) the details of which is given herein after. In this embodiment, as shown in FIG. 1 and FIG. 2, the direction to which the bed 1 extends, that is, the lateral direction is referred to as the X direction and the longitudinal direction perpendicular to the X direction is referred to as the Y direction.

On the bottom surface of the head, a needle bar 6 and a presser bar 7 are provided vertically moveably. On the lower end of the needle bar 6, a sewing needle 8 is attached and on the lower end of the presser bar 7, the embroidery fabric presser 9 is attached. In the bed 1, a thread loop taker (not shown) such as a rotating shuttle is provided for forming the stitches in co-operation with the sewing needle 7. Though details not shown, the main body of this embroidery sewing machine M is provided with a needle bar driving mechanism to drive the needle bar 6, thread take-up lever driving mechanism to drive the thread take-up lever, a shuttle driving mechanism to drive the thread loop taker and a sewing machine motor as their drive source.

Though details also not shown, the embroidery sewing machine M is provided with a control unit including a microcomputer. As known in the art, this control unit controls the carrier mechanism (X direction drive motor and Y direction drive motor) etc. of the embroidery frame carrier 5 described herein after. Because of this, the embroidery formation the embroidery cloth held by the embroidery frame 10 is automatically executed.

Next, the embroidery frame carrier 5 involved in the present embodiment is described with reference to FIGS. 1 to 10. The embroidery frame carrier 5 is configured by a carriage 11 detachably mounted with a connector 15 (described herein after) of the embroidery frame 10 and a carrier mechanism to horizontally move the carriage freely in the two mutually perpendicular directions: the X direction and the Y direction. The detailed structure of the carriage is described herein after.

As indicated in FIGS. 1 and 2, the embroidery frame carrier 5 is provided with a main body case 12 detachably attached in the bed 1 and a moveable case 13 provided on the upper surface of the main body case 12 which carries the carriage 11.

The main body case 12 is in a nearly oblong form with a flat upper surface, the right end of which is attachable to the end (left end) of the bed 1. In the attached state, the upper surface of the main body 12 and the upper surface (bed surface) of the bed 1 are level. Also, on the upper surface of this main body case 12, two slits 12*a* and 12*b* extending in the X direction (lateral direction) are formed.

The moveable case 13 is of an elongated oblong box extending to the longitudinal direction and in the upper surface of the main body case 12, the two longitudinal ends of the main body case 12 is in a length such that protrudes both to the front and rear sides respectively. At this point, thought not shown, a connection member is provided vertically penetrating each slit 12*a* and 12*b* of the main body case 12 and the upper end of the connection member is concatenated with the moveable case 13. Because each connection member moves along the slit 12*a* and 12*b*, the moveable case 13 can be moved to the X direction (lateral direction).

Inside the main body case 12, an X direction carrier mechanism not shown is provided to move the moveable case 13 to the X direction (lateral direction). As known in the art, the X direction carrier mechanism is configured for example by an X direction drive motor comprising a stepping motor and the mechanism to convert the driving power into a linear movement of the connection member in the X direction. By this X direction carrier mechanism, each connection member is moved to the X direction along the slits 12*a* and 12*b* to freely move the moveable case 13 and consequently the carriage 11 to the X direction (lateral direction).

On the right surface of the moveable cover 13, the carriage 11 elongated in the Y direction (front-rear direction) is moveably arranged. Inside the moveable case 13, a Y direction carrier mechanism not shown to move the carriage 11 in the Y direction is provided. The Y direction carrier mechanism similarly is configured for example by a Y direction drive motor comprising a stepping motor and the mechanism to convert the driving power into a linear movement of the connection member in the Y direction.

Figure 3:
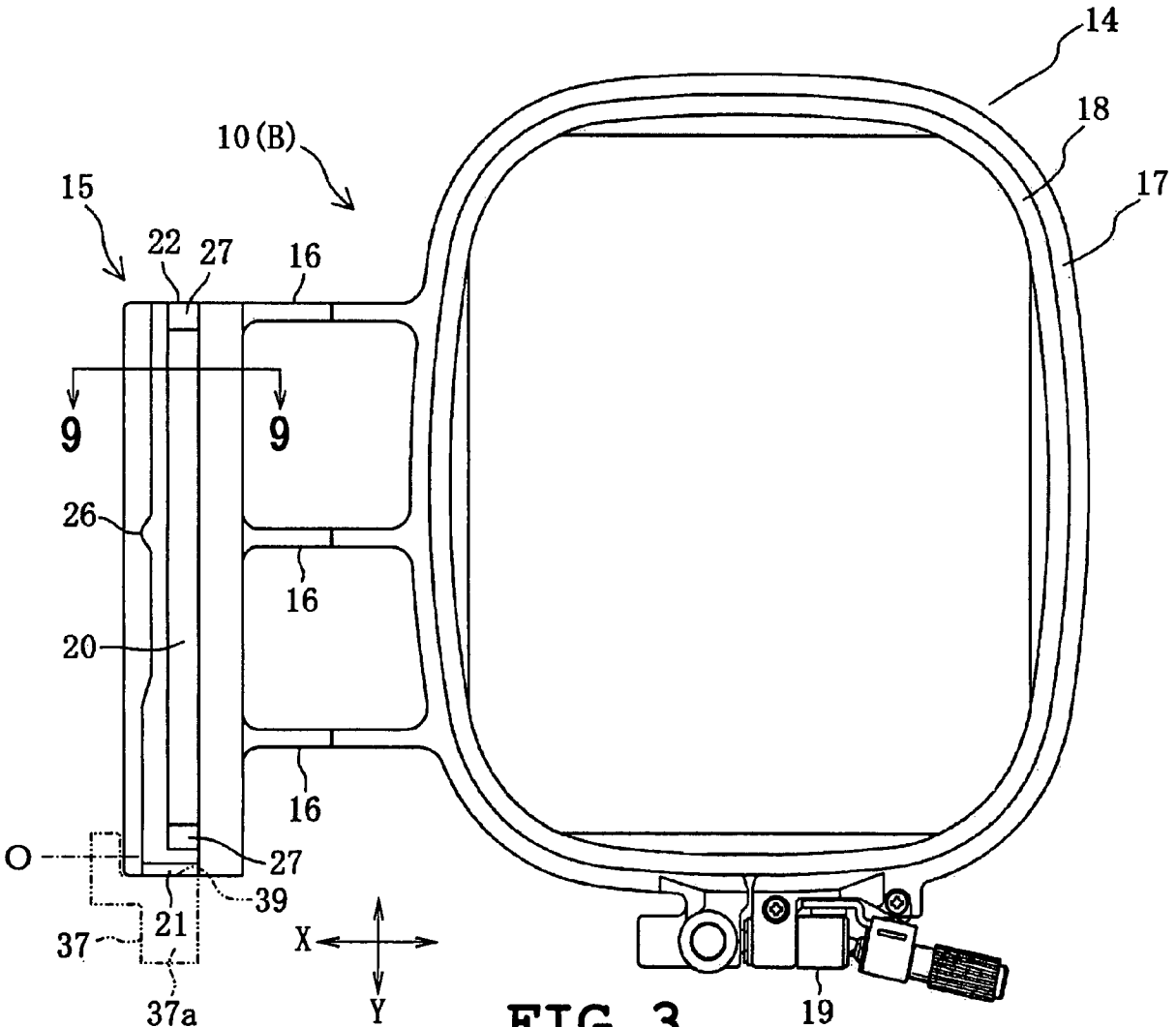
FIG. 3 shows a plan view of the embroidery frame.

Here, the embroidery frame 10 is described. As shown in FIGS. 2 and 3, the embroidery frame 10 is provided with a cloth holder 14 which is a frame to hold the embroidery cloth; a tightening mechanism 19 to attach/detach and adjust the strength of the hold of the cloth in the cloth holder and a connector 15 that is connected to the carriage 11. The fabric holder 14 is provided with an outer frame 17 and an inner frame 18 fitted detachably to the outer frame 17 and overall is of an oblong form with round corners. The embroidery cloth is clamped between the outer frame and the inner frame and furthermore, by tightening the outer frame 17 against the inner frame 18 by the tightening mechanism, the embroidery cloth is tightly stretched inside the frames.

In the present embodiment, a plurality of embroidery frames 10 of types varying in sizes and shapes are assumed and those embroidery frames 10 are arranged to be detachably (interchangeably) attached to the embroidery frame carrier 5. In FIGS. 2 and 3, different types of embroidery frames embroidery frame 10(A) and embroidery frame 10(B) are shown respectively. However, the only difference are the size, form and the configuration of the tightening mechanism 19, and the basic configuration including the configuration of the connector is the same, the same symbol is used for their description. Here, for example, in the embroidery frame 10(A) shown in FIG. 2, the lateral length multiplied by longitudinal length of the cloth holder 14 is approximately 160×260 [mm] and the cloth holder 14 of the embroidery frame 10 (B) shown in FIG. 3 is approximately 130×160. Also, the embroidery frame 10 (B) shown in FIG. 3 is provided with a link 16 in between the cloth holder 14 and the connector 15. A link 16 is provided in between the cloth holder 14 and the connector 15 and is arranged detachably and slidably in front-rear direction to the carriage 11.

Figure 9:
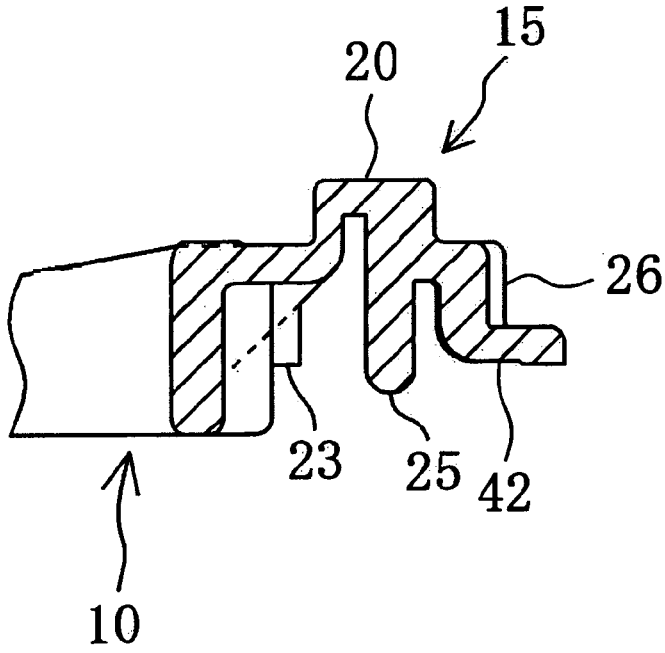
Figure 10:
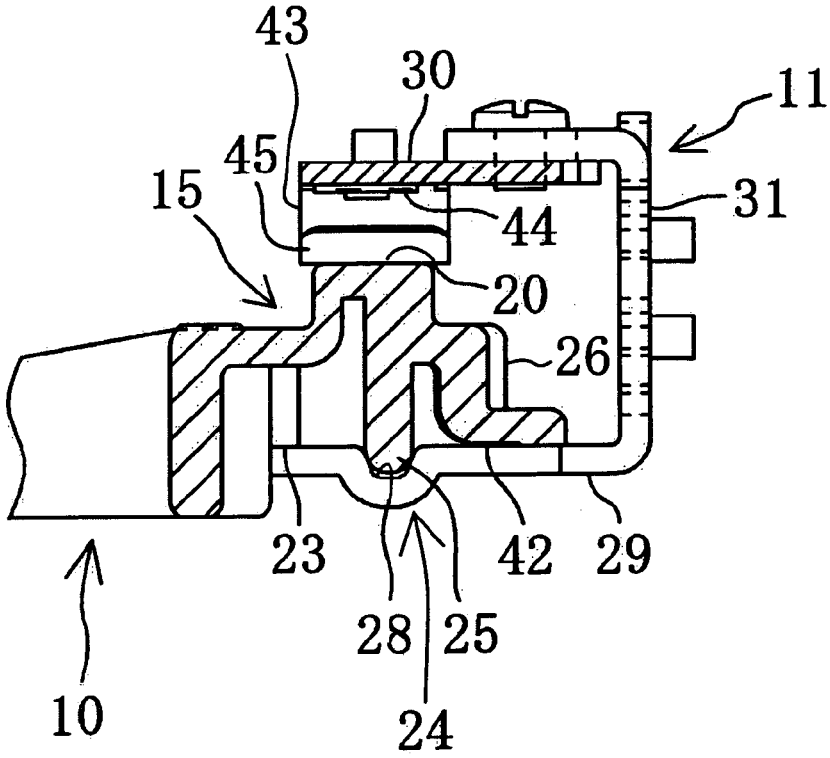
FIG. 10 shows a vertical rear elevation view along the line 10—10 in FIG. 7.

First, the configuration of the connector 15 is described with reference to FIGS. 3 to 10. As shown in FIG. 3, this connector 15 elongated in front-rear direction is of an oblong plate form when viewed from above. As shown in FIGS. 9 and 10, on the upper surface of the connector 15, a spring sliding surface 20 is provided. This spring sliding surface 20 is located in the lateral center of the connector 15 having a consistent width and formed horizontally extending entirely over the front-rear direction. Also, as shown in FIGS. 3 to 6, on the front and rear end of the spring sliding surface 20, an inclined guiding surface 27 is formed to smoothly insert the connector 15 to the carriage. On the front end of the connector 15, a pressure portion 21 having its upper portion cut off in a stepped form is provided and the rear end is referred to as the contacting portion 22.

Further, on the upper surface of the connector 15, as shown in FIG. 3, an identifier 26 is provided on the left side of the connector 15. This identifier 26 is arranged as a protrusion to the left (right side in FIGS. 9 and 10), and is provided so that the attachment status and the type of the embroidery frame 10 can be detected by the detection switch not shown. Although not shown, this identifier 26 is arranged so that its location in the front-rear direction (or the number of units provided) varies depending upon the type embroidery frame 10.

On the other hand, as shown in FIGS. 9 and 10, on the bottom surface of the connector 15, located immediately below the spring sliding surface 20, an engagement 25, a downward convexity extending entirely over the front-rear direction is provided. As described herein after, this engagement 25 together with the engagement groove 28 configures the engagement mechanism 24. Also, on the bottom surface of the connector, located in the right side of the engagement 25 (closer to the cloth holder 14) a carriage contact 23 is provided. Although details not shown, this carriage contact 23 is configured from a plurality of ribs spaced apart in the front-rear direction and formed integrally with the connector 15. This carriage contact 23 (a plurality of ribs) is for maintaining the horizontal disposition of the cloth holder 14 by contacting its lower end with the carriage 11 in the bottom surface of the connector 15.

As opposed to this, the carriage 11 is configured as follows. That is, the length of the carriage 11 in the front-rear direction is approximately the same as the connector 15 and as shown in FIG. 10, the carriage 11 is formed nearly in a laterally disposed cylinder when viewed in the front-rear direction. Concretely, it has a support wall 29 serving as a bottom surface, a vertical wall 31 extending upright from its left end, and the upper wall 30 extending rightward in the horizontal direction from the vertical wall. Also, as shown in FIGS. 4 to 8, the rear end of the support wall 29 is bent upright to serve as a stopper 36. Also, the lower end of the support wall 29 is bent downward. Therefore, the carriage 11 is formed as a box elongated in the front and rear direction with the front end surface (front side) and right side surface opened. The front end of the carriage 11 is referred as the insertion 46 for the connector 15 to be inserted when the connector is engaged to the carriage 11.

As shown in FIG. 10, the engagement groove 28 is provided extending entirely over the upper surface of the support wall 29. This engagement groove 28 is where the engagement 25 is slidingly engaged. The engagement groove 28 and the engagement 25 make up the engagement mechanism 24, in which the connector 15 is slidingly engaged in the front-rear direction to the carriage 11. The upper surface of the support wall 29 is of a flat surface besides the engagement groove 28 and the engagement 25 is engaged to the engagement groove 28 with the placement 42 in the left end bottom surface of the connector slidingly placed.

At this point, because the stopper 36 is provided on the rear end of the carriage 11, the connector 15 is engaged (inserted) to the carriage 11 from the front (insertion 46) as well as disengaged (pulled out) from the front (outward).

As shown in FIGS. 4 to 8, in the rear end of the carriage 11, a fastener 32 to fasten the connector 15 to the predetermined position in the carriage 11 in the sliding direction is provided and in the front end of the carriage 11, a lock mechanism to fixedly lock the connector 15, engaged by the engagement mechanism 24 is provided. Also, in the carriage 11, two units of holding plate spring 33 and 43 are provided as a biasing member to elastically bias the connector to the downward direction in which the engagement 25 is pressed against the engagement groove 28.

Among the above configuration, the fastener 32 is provided with a fastening plate 35 as an elastic member on the front surface of the stopper 36. The upper end of the elastic plate member 35 is fixed by the upper wall 30 and the lower portion is curved to expand in the forward direction. Because of this, when the contacting portion 22 of the connector 15 contacts the fastening plate spring 35, the elasticity of the fastening plate 35 gives a forward pressure force to the connector 15.

The lock mechanism 34 is provided with a rotating lever 37 as a lock member in the front end of the vertical wall 31 of the carriage 11. Therefore, the rotating lever 37 is arranged in a position to sandwich the connector 15 engaged to the carriage 11 with the fastener 32. As shown in the imaginary line in FIG. 3, the rotating lever 37 is provided with a stick-shaped lever main portion 37*a*, which is manually operated by the user and is in a crank form that extends leftward from the base end of the lever main portion 37*a* and takes a right angle turn to the right to further extend beyond. This rotating lever 37 is rotatably supported to the vertical wall 31 on its base end by the pivotal axis 38. Thus the rotating lever 37 is mounted so as to be able to be operated in a rotating manner having the axis extending in the lateral and horizontal direction as the rotational center O.

As shown in FIGS. 4 to 8, the rotational lever 37 can be rotationally operated in the range of 90 degrees between the release position (refer to FIGS. 4 to 6) in which it erects in the upper direction (vertical direction) and the pressured position (refer to FIGS. 8 and 3) in which it faces the horizontal and forward direction (in parallel to the sliding direction). Also, on the vertical wall 31, when the rotational lever 37 is in the released position, a plate spring 40 is provided to generate friction to maintain the released position. Furthermore, a pin member 41 is provided to regulate the rotation range of the rotating lever 37.

Figure 8:
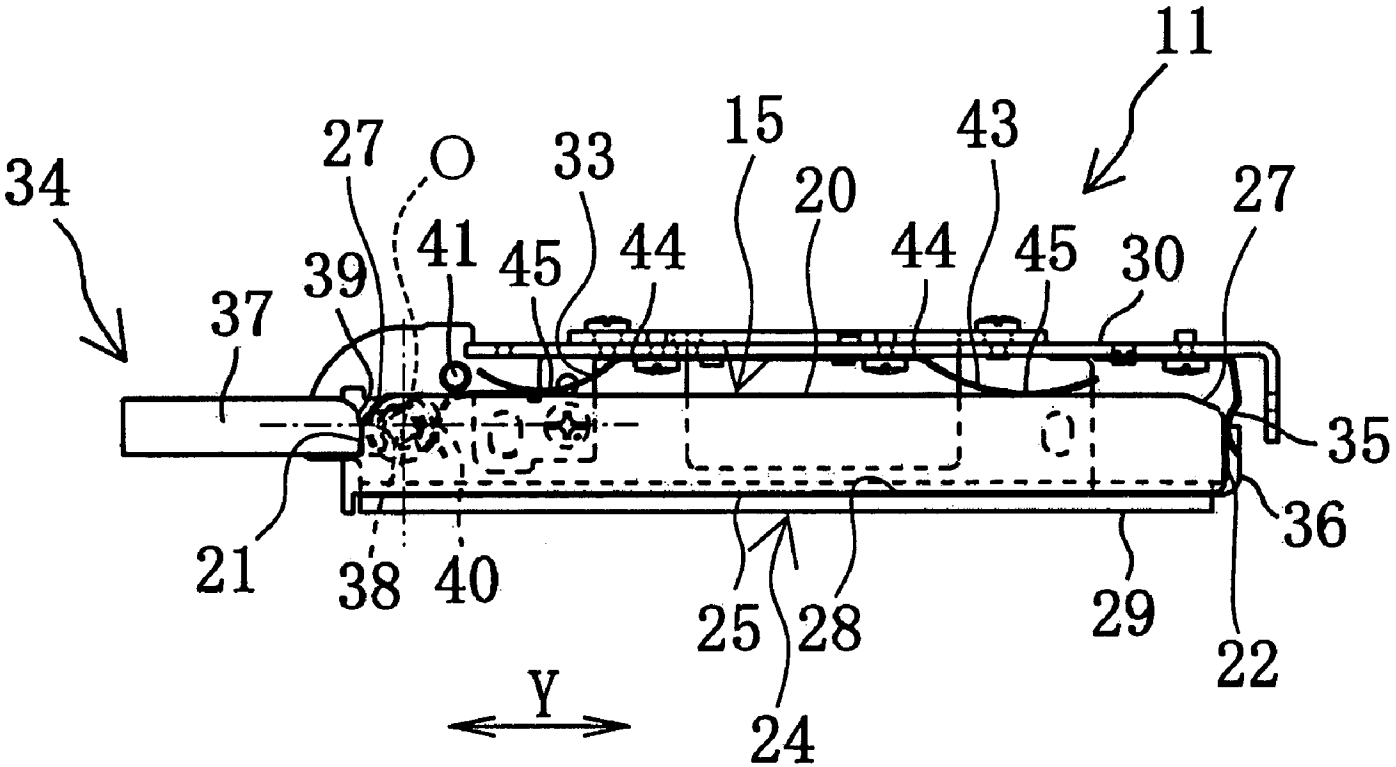
FIG. 8 shows a right side view of a rotating lever rotated in the pressured position.

When the rotating lever 37 is in pressured position, as shown in FIG. 8, the contacting portion 39 of the base end of the lever main portion 37*a* contacts the pressure portion 21 of the connector 15 and pressures the connector 15 to the rear direction. This pressures the contact portion 22 of the connector 15 to be pressed against the fastener 32 (fastening plate 35) and locks connector 15 in a fixed state. At this point, the contacting portion 39 contacts the pressure portion 21 of the connector 15 in level or slightly higher than the rotational center O.

Figure 4:
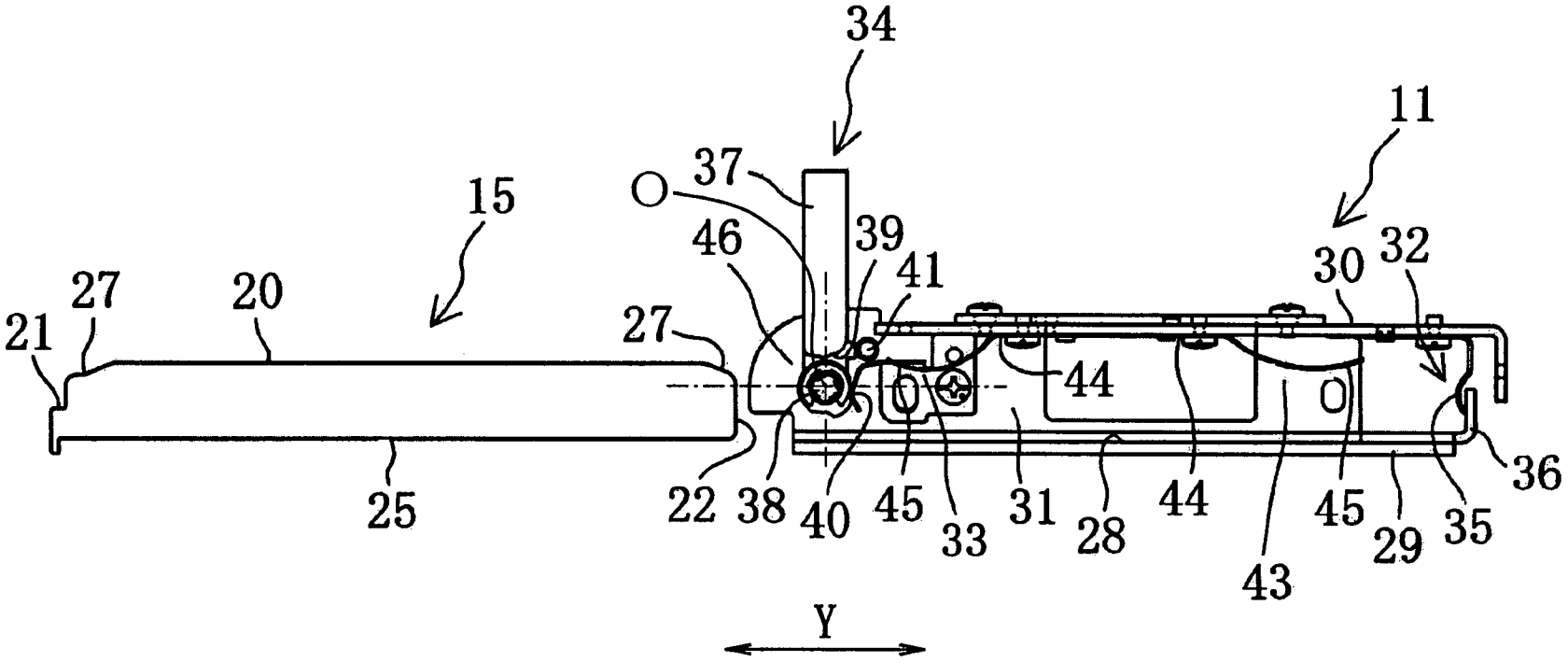
FIG. 4 shows a right side view of a connector and a carriage.
Figure 5:
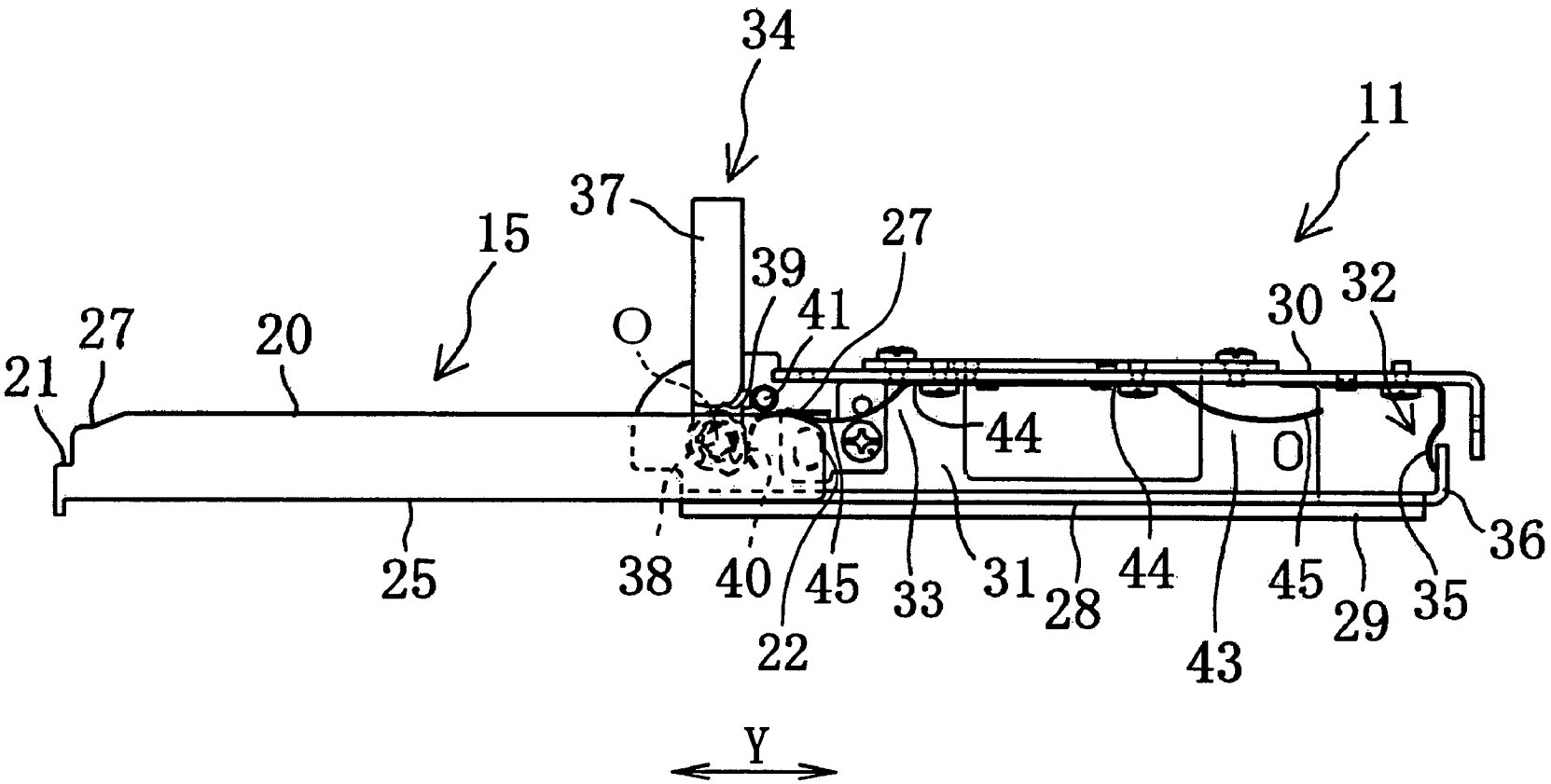
FIG. 5 shows a right side view of the connector being inserted (initial stage) into the embroidery frame.
Figure 6:
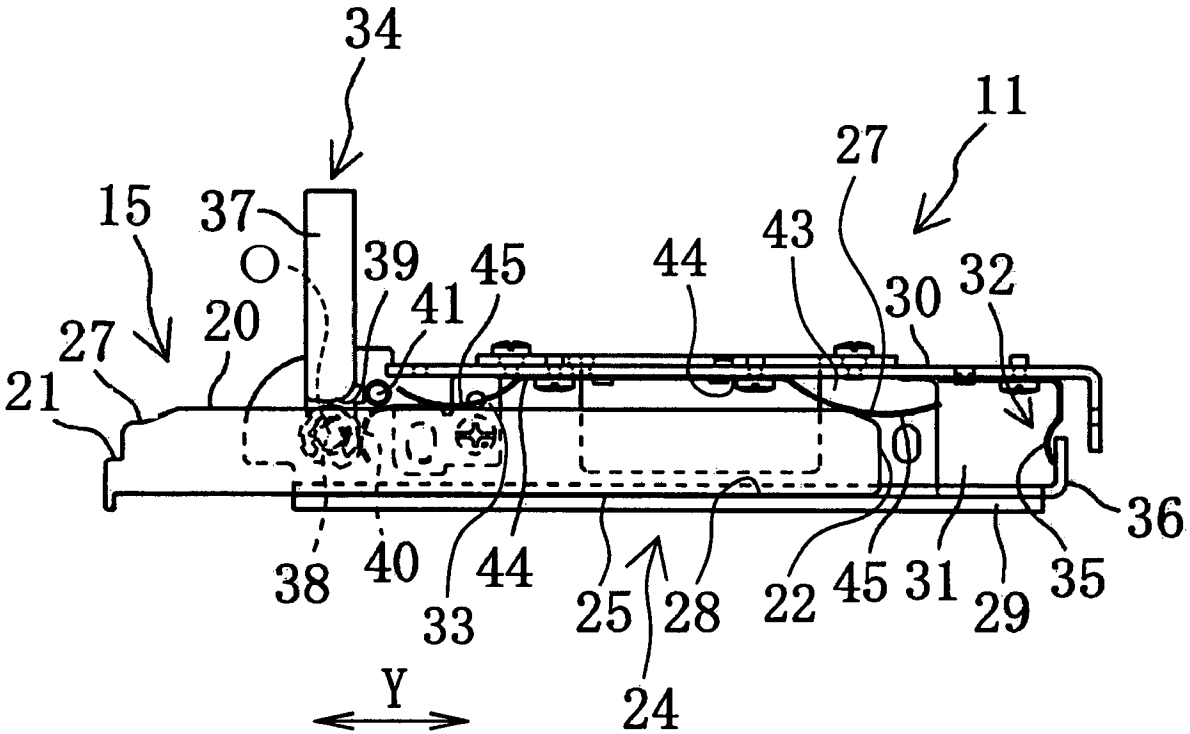
FIG. 6 shows a right side view of the connector being inserted into the embroidery frame.

Also, when the rotating lever 37 is in the release position, as shown in FIGS. 4 to 6, the lever main portion 37*a* is positioned in the upper position to release the insertion 46. The engagement (insertion) and release (pull out) of the connector 15 of the embroidery frame 10 to the carriage 11 is enabled in this state.

The holding plate spring 33 and 43 are provided on the front half and the rear half of the lower surface of the upper wall 30 of the carriage 11. These holding plate springs 33 and 34 extend in a nearly parallel direction (front-rear direction) with the engagement groove 28 as well as formed in a gradual curve to protrude downward. Also, the holding plate spring 33 and 43 are provided with a fixture 44 screwed on the carriage 11 (upper wall 30) and the free end 45 pressed in contact with the spring sliding surface 20 of the connector 15.

The holding plate spring 33 in the front side is arranged so that the free end 45 side is provided to extend outward, that is, the forward direction in the sliding direction to which the connector 15 is oriented when engaged to the carriage 11 and the free end is arranged near the insertion 46. In contrast, the holding plate spring 43 in the rear side has the free end 45 extending to the rear direction. Also, these holding plates 33 and 43 are configured so that the pressure force of the free end 45 is operated to the connector 15 in both the direction to pressure the engagement 25 to the engagement groove 28 (downward direction) and the direction nearly parallel to the sliding direction.

Next, the operation and effect of the above configuration is described. On attaching the embroidery frame 10 holding the embroidery fabric to the carriage 11 of the embroidery frame carrier 5, first, as shown in FIG. 4, the connector 15 is inserted into the carriage 11 with the rotating lever 37 of the lock mechanism 34 disposed in the release position (erected state). The insertion is carried out by engaging the engagement 25 onto the engagement groove 28 and sliding the connector 15 rearward from the insertion 46.

At this point, as shown in FIG. 5, the rear end of the connector 15 contacts the free end 45 of the holding plate 33, however because the inclined guide 27 is formed on the rear end of the spring sliding surface 20, the connector 15 is smoothly inserted into the carriage 11. After that, the connector 15 is slid in with the holding plate 33 sliding on the sliding surface 20. Because the elasticity of the holding plate spring 33 operates to the direction to insert the connector 15 in addition to the direction to pressure the spring sliding surface 20 of the connector 15 from above, the connector 15 can be inserted with an operation of relatively low burden.

Figure 7:
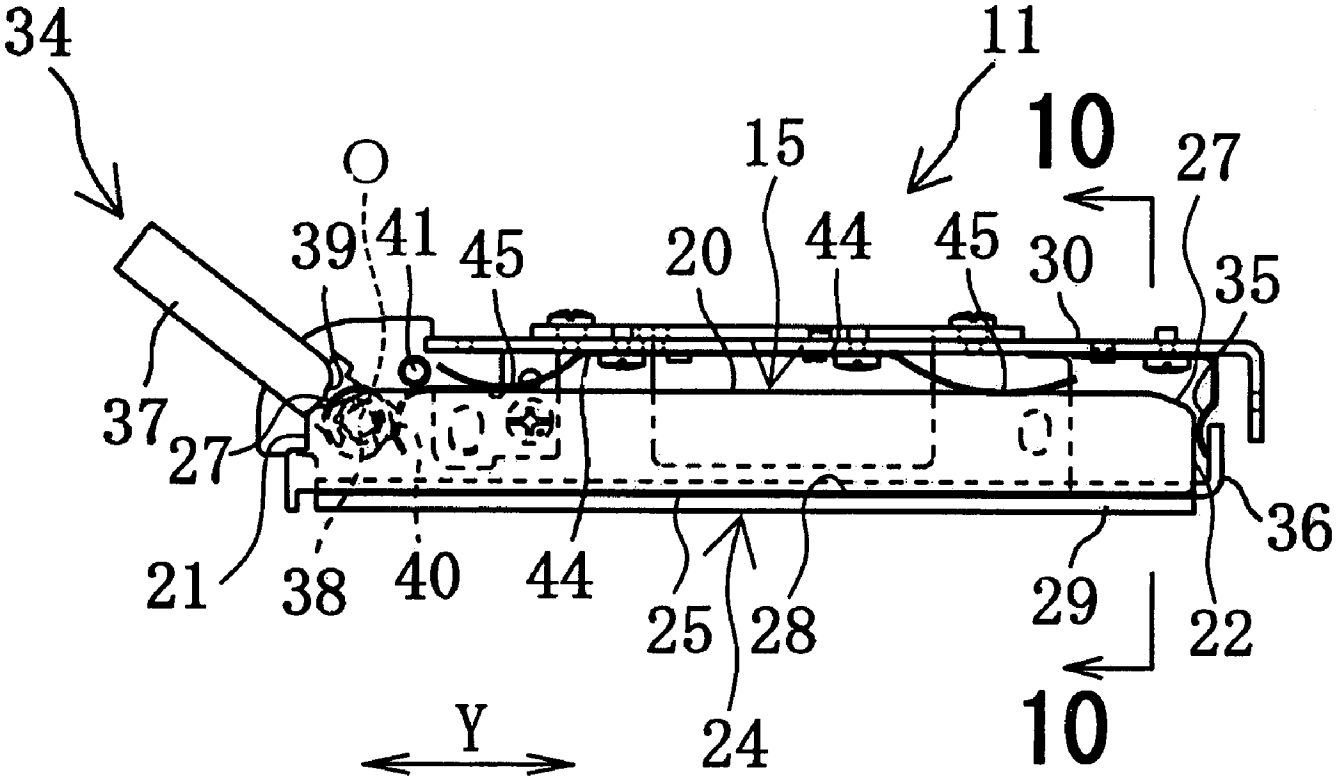
FIG. 7 shows a right side view of the connector contacting the fastener of the carriage.

After that, when the connector 15 is inserted further inward, as shown in FIG. 6, the connector 15 reaches the predetermined position after the holding plate spring 43 contacts the rear side of the spring sliding surface 20 of the connector 15 and as shown in FIG. 7, the contacting portion 22 of the connector 15 contacts the fastening plate spring 35. This is when the user rotationally operates the rotating lever 37 of the lock mechanism 34 to the pressure position (horizontal position).

Then, as shown in FIG. 8, the contacting portion 39 of the rotational lever 37 pressures the pressure portion 21 of the connector 15 in the rear direction. Because of this, the fastening plate spring 35 is pressured rearward to form a bend, and elasticity to pressure the connector 15 forward (towards the rotating lever 37) is generated. This elasticity sandwiches the connector 15 in between the rotating lever 37 and the fastening plate spring 35 in a pressed state, and fixedly locks the connector 15 to the carrier 11. Thus, the embroidery frame 10 is horizontally attached to the carriage 11 such that eliminates any play of the connector 15 within the carriage 11 in the sliding direction (front-rear direction).

Also, because of the pressure of the fastener plate spring 35, the rotating lever 37 is pressured to the front side by the connector 15, however, because the contacting portion 39 contacts the pressure portion 21 of the connector 15 in level or above the rotational center, the power does not operate in the direction to erect the rotational lever 37 thereby does not loosen the locked state.

Furthermore, in this attached state, because the connector 15 is pressed downward by the holding plate spring 33 and 43 the connector 15 is locked without any vertical play. At this point, the two holding plate springs 33 and 43 in the front and rear provides good balance in pressing the connector 15. Also, in this attached state, as shown in FIG. 10, because the carriage contact 23 configured by a plurality of ribs in the bottom surface of the connector 15 contacting the upper surface of the support wall 29 of the carriage 11, the horizontal disposition of the fabric holder 14 of the embroidery frame 10 is maintained.

The user can start the embroidery formation with the embroidery sewing machine M after the above state is obtained. The advantages of this arrangement are that the user will know at a glance whether the position of the rotating lever 37 is in the release position (erected state) or the pressured position (horizontal state) and that the starting of embroidery sew in premature insertion, that is, the insecure lock of the connector 15 into the carriage 11 can be effectively prevented.

In case the user desires to remove the embroidery frame 10 (connector 15) from the carriage 11, the opposite of the above is to be carried out, in which the rotating lever 37 is rotatably operated to the release position (erected state) then, disengaged from the carriage by pulling out the connector in the forward direction.

Thus, according to this embodiment, the attachment/detachment structure of the connector 15 of the embroidery frame 10 to/from the carriage 11 is provided with the engagement mechanism 24 having the engagement groove 28 and the engagement 25, the fastener 32 to fasten the connector 15 to the carriage 11 and the lock mechanism 34 to lock the connector 15 in a fixed state. Accordingly, the user can attach/detach the embroidery frame 10 smoothly and prevent the play of the attached embroidery frame 10 in the sliding direction. By providing the fastening plate spring 35 to the fastener 32, the play can be prevented even more effectively.

Also, in this embodiment, because the holding plate spring 33 and 43 are provided to bias the connector 15 in a direction to pressure the engagement 25 towards the engagement groove 28, the vertical play of the connector 15 in the vertical direction can be effectively prevented. Also, by providing a carriage contact 23 contacting the carriage 11 in the bottom surface of the connector 15, the horizontal disposition of the fabric holder 14 with the embroidery frame 10 attached can be maintained without increasing the spring force of the holding plate spring 33 and 43.

Furthermore, in this embodiment, because the rotating lever 37 is adopted as a lock member of the lock mechanism, the user can switch between the pressured position and the release position with a simple operation and moreover, the visibility of the rotating lever 37 is improved, thereby effectively preventing the premature insertion of the embroidery frame 10. The embodiment overall, enables the user to attach/detach the embroidery frame 10 easily with little effort.

Next, alternative embodiments of the present invention are described. Firstly, the engagement mechanism may be configured by providing the engagement groove on the connector 15 and the engagement which slidingly engages to the engagement groove provided on the carrier 11.

Secondly, the fastening plate spring 35 (biasing member) may be provided on the contacting portion 22 of the connector 15 instead of on the fastener 32.

Thirdly, one or more than two holding plate springs (biasing member) which press the connector 15 downward may be provided.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. An embroidery frame carrier for an embroidery sewing machine, which carrier moves an embroidery frame holding a work cloth to be embroidered in two mutually perpendicular directions, the embroidery frame carrier comprising:

a carriage to which a connector on an end portion of the embroidery frame is detachably mounted to support the embroidery frame;

a carrier mechanism freely moving the carriage in the two mutually perpendicular directions;

an engagement mechanism including an engagement groove provided on either one of the carriage or the connector of the embroidery frame and an engagement provided on the other so as to engage the engagement groove, the engagement mechanism engaging the connector to the carriage so that the connector is slidable on the carriage horizontally along a length of extension;

a lock portion provided in the carriage to engage one end of the connector of the embroidery frame to a predetermined location in a direction of a sliding movement, the lock portion including a fastener;

a lock mechanism provided in the carriage to engage the other end of the connector engaged by the engagement mechanism in a fixed state; and a lock member provided in the lock mechanism to be switched between a pressed position in which the connector is pressed against the fastener and a released position in which the connector is released from a pressed state.

2. The embroidery frame carrier according to claim 1, wherein the connector of the embroidery frame has an end located in the direction of the sliding movement and having a contact portion which is abutted against the lock portion, and either lock portion or contact portion is provided with a resilient member rendering the abutment resilient.

3. The embroidery frame carrier according to claim 1, wherein the lock member includes a rotating lever with one end rotatably supported by the carriage.

4. The embroidery frame carrier according to claim 3, wherein the rotating lever is disposed at a position where the connector of the embroidery frame in engagement with the carriage is sandwiched between the lock portion and the rotating lever, and the rotating lever assumes a substantially parallel position to the direction of the sliding movement when the lock member is in the pressed position, the rotating lever further assuming a standing position in the direction of the sliding movement when the lock member is in the released position.

5. The embroidery frame carrier according to claim 4, wherein the rotating lever is provided with a contacting portion contacting the connector of the embroidery frame in the pressed position and the contacting portion is arranged to contact the connector of the embroidery frame on a level with or higher than a rotational center of the rotating lever.

6. The embroidery frame carrier according to claim 2, wherein the resilient member includes a lock leaf spring.

7. The embroidery frame carrier according to claim 6, wherein the engagement mechanism includes a biasing member elastically biasing the connector in such a direction that the engagement of the engagement mechanism is pressed against the engagement groove while the engagement is in engagement with the engagement groove.

8. The embroidery frame carrier according to claim 7, wherein the biasing member includes a holding leaf spring.

9. The embroidery frame carrier according to claim 8, wherein the holding leaf spring has a pressing force set so as allow the connector to slide by the pressing force of the lock leaf spring.

10. An embroidery frame carrier for an embroidery sewing machine, which carrier moves an embroidery frame in two mutually perpendicular directions, the embroidery frame having a frame-shaped cloth holder holding a work cloth to be embroidered and a connector provided on an end of the cloth holder, the embroidery frame carrier comprising:

a carriage to which the connector of the embroidery frame is detachably mounted to support the embroidery frame;

a carrier mechanism freely moving the carriage in the two mutually perpendicular directions;

an engagement mechanism including an engagement groove provided on either one of the carriage or the connector of the embroidery frame and an engagement provided on the other so as to engage the engagement groove, the engagement mechanism engaging the connector to the carriage so that the connector is slidable on the carriage horizontally along a length of extension;

a biasing member provided on the engagement mechanism to elastically bias the connector in such a direction that the engagement of the engagement mechanism is pressed against the engagement groove while the engagement is in engagement with the engagement groove; and a carriage abutment portion provided in an area of the connector closer to the cloth holder so as to abut against the carriage on a surface of the carriage abutment portion opposing to a portion of the connector pressed by the biasing member.

11. The embroidery frame carrier according to claim 10, wherein the carriage abutment portion includes a plurality of ribs formed on an underside of the connector and each rib has such a height as to maintain the cloth holder in a horizontal position.

12. The embroidery frame carrier according to claim 10, wherein the biasing member includes a holding leaf spring.

13. The embroidery frame carrier according to claim 12, wherein the holding leaf spring has a fixed portion fixed to the carriage and a free end which is in contact with the connector to press the connector and is formed so as to extend substantially in parallel to the engagement groove, and a pressing force of the free end is arranged to act on the connector both in a direction in which the engagement portion is pressed against the engagement groove and in a direction substantially in parallel to the direction of the sliding movement.

14. The embroidery frame carrier according to claim 13, wherein the free end of the holding leaf spring is disposed front with respect to the direction of the sliding movement of the connector when the connector is engaged with the carriage.

15. The embroidery frame carrier according to claim 13, wherein the connector has an end and the carriage has an insertion hole into which the end of the connector is inserted when the connector is engaged with the carriage and the free end of the holding leaf spring is disposed in the vicinity of the insertion hole.

* * * * *